United States Patent [19]

Mirhej

[11] 4,383,817

[45] May 17, 1983

[54] SPINNERET PLATE

[75] Inventor: Michael E. Mirhej, Signal Mountain, Tenn.

[73] Assignee: E. I. Du Pont de Nemours and Company, Wilmington, Del.

[21] Appl. No.: 347,925

[22] Filed: Feb. 11, 1982

[51] Int. Cl.[3] ..... A01J 21/00

[52] U.S. Cl. ..... 425/463; 264/103; 264/176 F; 264/177 F; 425/464

[58] Field of Search ..... 425/461–466; 264/237, 177 F, 171, 176 F, 103

[56] References Cited

U.S. PATENT DOCUMENTS

| | | | |
|---|---|---|---|
| 3,412,191 | 11/1968 | Kitajima et al. | 264/181 |
| 4,110,965 | 9/1978 | Bradley et al. | 57/157 TS |
| 4,332,758 | 6/1982 | Blackman et al. | 264/171 |

FOREIGN PATENT DOCUMENTS

| | | | |
|---|---|---|---|
| 43-5164 | 2/1968 | Japan | 264/167 |
| 43-28770 | 12/1968 | Japan | 264/176 F |
| 47-42522 | 10/1972 | Japan | 264/237 |

*Primary Examiner*—Jay H. Woo

[57] ABSTRACT

A spinneret plate having capillaries of different length, and preferably capillaries of different cross-sectional shape. The spinning plate has a boss through which some of the capillaries pass.

10 Claims, 5 Drawing Figures

SPINNERET PLATE

BACKGROUND OF THE INVENTION

Figure 1:
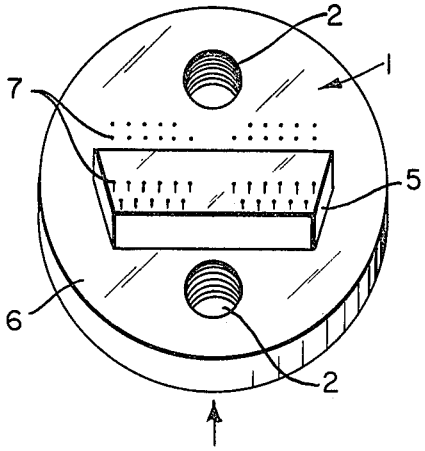

This invention relates to a spinneret plate for use in the production of filaments such as textile or industrial yarn from a molten polymer of fiber forming molecular weight. In particular this invention relates to a spinneret plate that may be used to produce a yarn containing filaments having widely different physical properties, i.e., elongation and tenacity; such a yarn may be processed in such a manner that the filaments in the yarn with lower elongation and tenacity break and yield a product having free ends, or such a yarn may be processed to yield a mixed shrinkage yarn. The spinneret plate may have capillaries of different cross-sectional size and shape. The spinneret plate must have capillaries of different length. (The term "capillary" as used herein means the aperture through the spinneret plate through which polymer passes during a spinning operation, and includes any counterbore. A counterbore often extends the major distance through the plate.)

It is known in the art to spin fibers from a spinneret plate having different shaped capillaries—for example see Bradley U.S. Pat. No. 4,110,965. Bradley also discloses breaking the weaker filaments in or subsequent to the stop of false twist texturing the yarn.

It is also known that yarn properties are affected by the spinning temperature at the spinning surface (extrusion face) of the spinneret. The present invention makes it possible to spin a yarn having filaments with different properties from a single spinneret without the use of elaborate heat exchange equipment to cool one group of capillaries but not another.

SUMMARY OF THE INVENTION

The present invention is a spinneret plate having a first planar surface, a plurality of capillaries extending through the plate at right angles to the plane of the planar surface, some of said capillaries being a different length than other of said capillaries. The capillaries differ in length because the plate has different thickness in different areas, e.g., the plate may have a boss on the surface opposite the first planar surface, or an indentation in the surface opposite the first planar surface, and some of the capillaries extend through the boss or come out in the indentation. The surface opposite the first planar surface is also planar and could be parallel to the first planar surface, but said surface must have a boss or indentation. The boss or indentation may be of numerous shapes, for example, a cube or other polyhedron, or in the form of a ring—a hollow cylinder. The height of the boss or the depth of the indentation should be such that the capillaries differ in length by between about 0.5 cm and about 2.5 cm, preferably about 1 to 2 cm.

Often the boss or indentation will have a planar surface that is parallel to the first planar surface of the spinneret plate, and a multiplicity of capillaries will extend through the planar surface. However, the boss or indentation may have a planar surface that is inclined with respect to the first planar surface of the spinneret plate.

FIGS. 1–5 illustrate five different embodiments of the spinneret plate of this invention. In the figures, like numbers illustrate like features.

FIG. 1 is a prospective view of a spinneret plate 1, having screw holes 2 for attaching the plate to the block of a spinning machine. Boss 5 is located on planar surface 6. The spinning plate also has a planar surface opposite planar surface 6 that is parallel thereto. Four rows of capillaries 7 extend through the spinneret plate—two rows passing through the boss and two rows through the planar surface 6.

Figure 2:
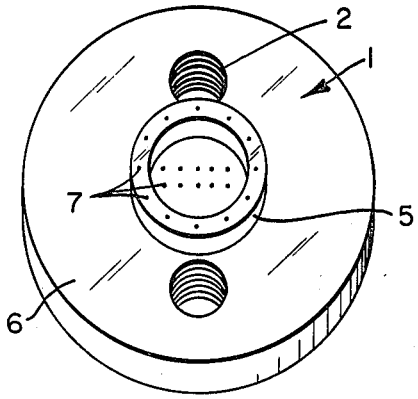

FIG. 2 shows a spinneret plate similar to FIG. 1 except that the boss is in the form of a ring or hollow cylinder, and capillaries 7 extend through the spinneret plate—some through the boss and some through the planar surface 6.

Figure 3:
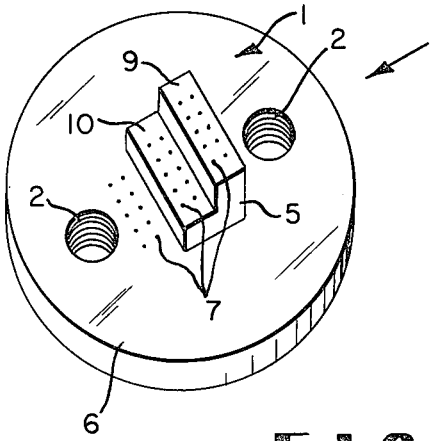

FIG. 3 shows a spinneret plate similar to FIGS. 1 & 2 except that the boss has two different planar surfaces 9 and 10 that are parallel to the surface of the planar surface 6. Capillaries 7 extend through the spinneret plate, some through planar surface 6 and some through planar surface 9 and some through planar surface 10.

Figure 4:
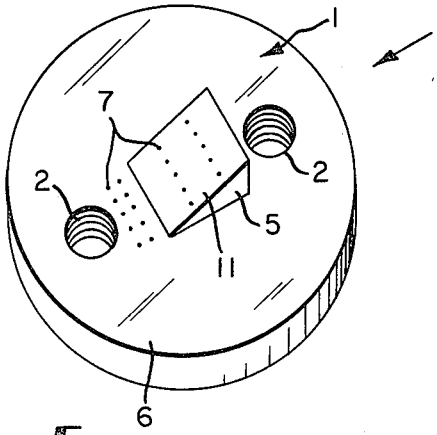

FIG. 4 is another embodiment similar to FIGS. 1–3, except in this embodiment the boss has a planar surface 11 that is inclined with respect to planar surface 6. The capillaries 7 pass through the spinneret plate—some through the planar surface 6 and some through planar surface 11 at different distances from planar surface 6.

Figure 5:
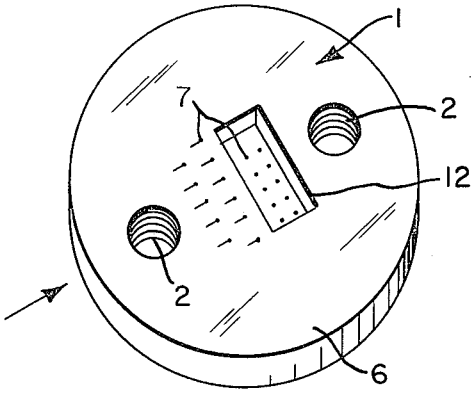

FIG. 5 is another embodiment in which the planar surface 6 has an indentation 12. Some capillaries 7 extend through the plate in the indentation area, and some extend through planar surface 6.

Spinnerets of the type illustrated in FIGS. 1, 3, 4 and 5 would normally be used on spinning machines where the flow of quenching air is lateral, and the spinneret illustrated in FIG. 2 would be employed when the spinning machine uses radial quenching air. The spinneret plates of FIGS. 1, 3 and 4 would normally be mounted so that the flow of quenching air is shielded by the boss from those capillaries that do not pass through the boss. The arrow accompanying FIGS. 1, 3, 4 and 5 shows the normal direction of air flow.

The use of the spinneret of this invention results in yarn with filaments having different properties. Filaments spun through capillaries that go through the boss are spun at a lower temperature due to localized cooling of the plate in the area of the boss, than are filaments that are spun through capillaries that do not go through the boss. Furthermore, the boss shields the filaments that do not pass through it from the quenching air and thus makes it possible to accentuate the difference in orientation between the fibers spun from the different sections of the spinneret. Thus fibers spun through capillaries that do not go through the boss will be less oriented and have a greater tenacity than the fibers that are spun through capillaries that do penetrate the boss. The difference in fiber properties can be further affected by using capillaries having different shapes in the boss and the non-boss regions. For example, the capillaries passing through the boss may be key-hole shaped or slot shaped or triskelion shaped, and the capillaries that do not pass through the boss, circular or symmetrically multilobal in cross-sectional shape. The size of the spinning aperture may also be varied. The filaments that are spun through the noncircular capillaries that pass through the boss will have a nonuniform orientation—since the thin section of the filament loses heat faster than the thicker area. The result is that when yarns containing fibers of these two types are stretch broken—as described in the Bradley patent, the fibers that were spun through the boss, break first and later, when subjected to heat treatment, tend to curl and twist—thus the free ends are present to give the yarn the feel of staple, but the ends are twisted about and thus do not readily form pills on fabrics.

EXAMPLE

A spinneret plate of the type illustrated in FIG. 1 had the following dimensions: the plate is approximately 1.25 cm thick having a boss 5 approximately 1.25 cm thick. The boss has about 6.5 cm in its longest dimension, and 1.75 cm wide. The boss has two rows of capillaries, 10 in the first row and 12 in the second. The rows are about 6 mm apart and are offset so that the capillaries in the second row when viewed laterally to the length of the row appear to be midway between the capillaries in the first row. The capillaries are key-hole shaped, about 30 mils (0.76 mm) long, 3 mils (0.076 mm) wide and having an enlarged circular end about 9 mils (0.23 mm) in diameter. The enlargement is located at the end adjacent round capillaries. These capillaries have a circular counterbore on the melt side (the side without the boss) about 0.16 cm in diameter and about 2.3 cm deep. Two additional rows of capillaries which penetrate the spinneret plate in the area not covered by the boss, are located in two lines that are parallel to the rows of capillaries that penetrate the boss. The row adjacent the boss contains 12 capillaries, and the other row contains 10 capillaries. These capillaries have a circular counterbore on the melt side (the side without the boss) about 0.16 cm in diameter and about 1 cm deep. The rows are about 1.25 cm apart. These rows of capillaries are not offset. These capillaries are round and have a diameter of approximately 13 mils (0.33 mm). Such a spinneret plate can be used in the conventional manner to produce polyester filaments, and is preferably mounted so that the stream of quenching air will first strike the filaments that originate from capillaries that penetrate the boss—the key-hole shaped capillaries.

I claim:

1. A spinneret plate for use in spinning synthetic polymeric filaments having a first surface which is planar, a plurality of capillaries extending through said plate at right angles to the plane of the first surface, some of said capillaries being a different length than other of the capillaries, said capillaries having a counterbore that extends from the first surface a portion of the distance through said plate.

2. The spinneret plate of claim 1 which has a second planar surface which is parallel to said first planar surface, said second planar surface having a boss thereon, only a portion of said capillaries passing through said boss.

3. The spinneret plate of claim 2 in which the boss has a planar surface that is parallel to the first and second surface of the plate.

4. The spinneret plate of claim 3 in which the boss is cylindrical, and the center of the cylinder is at a different distance from said second planar surface of the plate than is the ouer edges of the cylinder.

5. The spinneret plate of claim 2 in which the boss has at least two planar surfaces that are parallel to said first and second surfaces of the plate and some capillaries extend from the first planar surface of the plate through the boss at one planar surface, and some other capillaries extend from the first planar surface of the plate through the boss at a second planar surface.

6. The spinneret plate of claim 2 in which the surface of the boss through which some of the capillaries extend is inclined with respect to the first surface of the plate.

7. The spinneret plate of claim 1 in which some of the capillaries have different cross-sectional shapes.

8. The spinneret plate of claim 2 in which the capillaries that pass through the boss have a different cross-sectional shape than the other capillaries.

9. The spinneret plate of claim 8 in which the capillaries that pass through the boss have a keyhole cross-section.

10. The spinneret plate of claim 8 in which the capillaries that pass through the boss are slots.

* * * * *